US008763810B2

(12) United States Patent
Zorzo

(10) Patent No.: US 8,763,810 B2
(45) Date of Patent: Jul. 1, 2014

(54) STACKABLE CLEANING BUCKET

(75) Inventor: Renato Zorzo, Onara di Tombolo (IT)

(73) Assignee: T.T.S. s.r.l., S. Giustina in Colle (IT)

( * ) Notice: Subject to any disclaimer, the term of this patent is extended or adjusted under 35 U.S.C. 154(b) by 0 days.

(21) Appl. No.: 13/574,620

(22) PCT Filed: Jan. 19, 2011

(86) PCT No.: PCT/IB2011/000094
§ 371 (c)(1),
(2), (4) Date: Jul. 22, 2012

(87) PCT Pub. No.: WO2011/089515
PCT Pub. Date: Jul. 28, 2011

(65) Prior Publication Data

US 2012/0292222 A1 Nov. 22, 2012

(30) Foreign Application Priority Data

Jan. 22, 2010 (IT) ..... PD2010A0010

(51) Int. Cl.
*B65D 21/00* (2006.01)

(52) U.S. Cl.
USPC ..... 206/516; 206/519; 206/515

(58) Field of Classification Search
USPC ..... 206/515, 516, 519
See application file for complete search history.

(56) References Cited

U.S. PATENT DOCUMENTS

| | | | | |
|---|---|---|---|---|
| 2,470,432 | A * | 5/1949 | Cusick | 220/23.4 |
| 2,896,809 | A * | 7/1959 | Metzger et al. | 220/553 |
| 3,409,193 | A * | 11/1968 | Metcalf | 224/540 |
| 4,133,445 | A * | 1/1979 | Mandelbaum | 220/23.4 |
| 2008/0006640 | A1 | 1/2008 | Natale | |

FOREIGN PATENT DOCUMENTS

| | | | |
|---|---|---|---|
| CH | 683172 | A5 | 1/1994 |
| DE | 9015805 | U1 | 2/1991 |

* cited by examiner

*Primary Examiner* — Steven A. Reynolds
*Assistant Examiner* — King M Chu
(74) *Attorney, Agent, or Firm* — QuickPatents; Kevin Prince

(57) ABSTRACT

This is a stackable cleaning bucket composed of two adjacent compartments divided by a partition, where the bucket has the merit of being able to be stacked inside a similar bucket practically up to the top edge, and which is equipped with sufficient structural rigidity when in use, with the positioning at the bottom of the two compartments of a spacer element that connects them.

8 Claims, 5 Drawing Sheets

STACKABLE CLEANING BUCKET

CROSS-REFERENCE TO RELATED APPLICATIONS

This application claims the benefit of PCT Patent Application PCT/IB2011/000094, filed on Jan. 19, 2011, and Italian Patent Application PD 2010 A 000010, filed on Jan. 22, 2010, both incorporated herein by reference.

STATEMENT REGARDING FEDERALLY SPONSORED RESEARCH AND DEVELOPMENT

Not Applicable.

FIELD OF THE INVENTION

This invention relates to containers, and more particularly to a stackable cleaning bucket.

DISCUSSION OF RELATED ART

Currently, with the pursuit of greater speed, care and diligence in cleaning operations, the cleaning of a floor has to be done in a single operation instead of the usual two.

To carry out the above-mentioned function, sector operators prefer a bucket that generally has two separate compartments, one for the washing water, usually with some detergent suitable for the conditions you have to work in, and another for the rinse water, because frequent rinses are required.

Alternatively, and more generally, said first compartment contains dirty liquid and the second contains clean liquid, generally with a suitable detergent.

The above-mentioned two compartments in the bucket are obtained by means of the installation or the presence of a structure that forms the compartments.

This compartmentalization was initially created through a removable partition panel inserted within a special guide, in the form of a groove on bucket with a single compartment.

Nevertheless, the difficulties of equipping a bucket with just a single basin and the drawbacks that this accessory involved, have meant that operators in the sector have preferred different solutions.

The difficulty of equipping a bucket with a single basin is mainly related to the insertion and removal of this removable partition, which has to be easily installed (to be pushed forcibly in the guide groove that has to provide the waterproof seal) and has to be equally easy to remove, but which at the same time has to provide the waterproof sealing for each compartment, so as not to pollute the liquid contained in one compartment with the liquid contained in the other, and also to ensure, in the event there is liquid just in one compartment, leakage to the empty adjacent compartment.

The drawbacks that this accessory has involve mainly the difficulty of keeping the bucket clean at the edges inside which the above-mentioned removable partition is housed.

In fact the guide groove, or channel, which is raised with respect to the interior surfaces of the bucket and embedded and therefore sunken into the surface profile of the walls and the bottom of the bucket, because they necessarily have to have a width basically the same as that of the removable partition, is not easily reached for cleaning, so it accumulates dirt especially along the edges.

For the above-mentioned reasons, buckets are normally used that have two co-pressed compartments next to each other and connected at the top and on the side along both sides (for the entire or most of the vertical span).

The element that separates the two compartments was initially devised as a partition, common to both compartments, generally in the middle inside the bucket, which connected the two main longitudinal walls for their entire, or almost, height or vertical span.

Later, because of problems connected to the extraction of the molds of the bucket that had a partition, it was necessary to apply a draft angle to the partition.

If by using this well-known method it was possible to easily extract the above-mentioned bucket from the mold, it nevertheless proved to be very taxing because of the amount of material used and the exaggerated dimensions in relation to the stresses that this partition was subjected to.

Therefore, as a further and definitive development, a partition was made between male in the mold, to be inserted in the lower part of the bucket, in such a way that the male-shaped insert created two walls (one for each compartment), suitably inclined, and quite close to each other, and joined at the top.

These two walls created the above-mentioned partition.

The perimeter surface of this bucket, seen from the outside, (like traditional buckets without a partition) is generally continuous with the outside perimeter surface of the compartments and capable of conferring the necessary stability and strength to the structure of the bucket composed of the two above-mentioned compartments.

This arrangement is the one in the cleaning buckets that are currently on the market.

Even if this configuration fully satisfies user requirements, nevertheless also these solutions have some serious drawbacks.

In fact manufacturers, who have always been careful in reconciling the performance and features of their products with the costs of production and packing, storage, shipping, found themselves having considerable difficulties and additional charges as regards the aspect of storage, packing and shipping, with an increase in the space taken up by these products in the warehouse and considerable expenses for packing and shipping.

In fact, the presence of a partition, practically in the middle of the compartment, in reality prevents this type of bucket being stacked one inside another; each bucket practically occupying the entire volume of its nominal capacity, and necessitating during packaging and shipment for each single product a space equal to the individual dimensions of each bucket.

Experimental solutions have been tried out to resolve these drawbacks, but with poor and questionable results.

Up until now, therefore, it is well known that a bucket equipped with a central partition costs more than one without this division, not only because of the depreciation cost of the molds used and the cost of the additional material (generally plastic), but also and especially because of the greater space taken up in each phase, especially in the storage, packing and shipping phases.

If the above-mentioned drawbacks acutely affect manufacturers, retailers and also end-users, the problems connected to the use of these buckets are also important.

In fact these drawbacks are particularly felt in cleaning companies that, having to very often use numerous buckets (usually of the same model), find themselves needing a store for equipment, or a warehouse for various types of cleaning instruments, which is not so tidy and overflowing because of the impossibility of being able to stack the buckets with a partition one on top of another. In fact the buckets, together with any trolleys, represent the majority of the cleaning tools and are more cumbersome and unwieldy than those normally used by cleaning companies. If, moreover, we think of a small company that has to continually move around with its vehicles between the various places it carries out cleaning, the large amount of space taken up by two or more buckets needed for work becomes extremely important.

An example of a bucket with the above-mentioned drawbacks is shown in US2008/0006640 A1, which describes a stackable bucket with at least two adjacent compartments, separated by a partition that connects said compartments at least at the top; said bucket is composed of a rigid material, often to provide the necessary structural rigidity for the use of the bucket itself.

Moreover patent CH683172 shows various ways of reinforcing the structural rigidity of some types of stackable buckets, without however overcoming the drawbacks described above.

SUMMARY OF THE INVENTION

The purpose of the invention described below is to overcome all the drawbacks set out above and others that will become evident later in the description.

In fact all the above-mentioned problems are resolved with the object of this patent application containing a cleaning bucket composed of two adjacent compartments separated by a partition, which can be easily stacked for most of their height, and which is fitted with one or more spacing elements that keep said compartments properly spaced apart and/or constitute a solid connection between the two said compartments.

Preferably said division is composed of a partition that is composed of two walls, suitably inclined, and quite close to each other, joined together at the top.

Conveniently, said spacers that keep the compartments at a suitable distance from one another are applied after extraction from the mold and preferably before the use of the bucket accessorized with them. Said spacers can be made as separate elements but also as elements already present in the molding, needing only their positioning in an active configuration (for example a rotation with successive snap-in engagement).

Very usefully said spacers are clevis-shaped (metal or plastic), to be inserted in special housings at the bottom of each compartment near the edge that faces the adjacent compartment.

Nevertheless, it is extremely advantageous that these spacers can take any form that continually connects the peripheral surface of the bucket at the small space of the partition panel.

In the event that during the storage of the cleaning equipment after use, stacking with other identically structured buckets is needed, in order to save space, this will be very easy and quick following the removal of said spacer elements by the operator (or their repositioning in a non-active configuration), thereby permitting stacking on a base bucket (on which no other operation needs to be carried out) of one or more buckets, taking up just a little more vertical space (in general just a little more than the upper reinforcement edge that cleaning buckets usually have) than that of the base bucket.

In the eventuality that the buckets are fitted with lateral extensions that enhance the base, extensions on which the lower wheels are fixed and which generally are applied in the lower corner of the bucket (or on the outer perimeter generally diametrically opposite one another), the result is unchanged if said extensions (both the front and back ones) are not there during storage and transportation and/or are removed before stacking one bucket on top of another.

Equally positively, the result are just slightly inferior (but always much better than the current state of the art) if at least one pair of these extensions is removed as explained above.

Also when there are handles, usually hinged to the top reinforcement edge and with a very small cross-section, the result that can be obtained with the stacking is not compromised, by positioning the handles adjacent to the top edges in a basically horizontal position (if the edge of the bucket is in the same position).

In particular the result attained resolves the drawbacks present in current buckets with an intermediate partition (which cannot be stacked) with the practicality and convenience of traditional buckets that can easily be stacked.

The above-mentioned device can be easily understood from a preferred example, and not limited to this only, with reference to the enclosed drawings.

DETAILED DESCRIPTION OF THE PREFERRED EMBODIMENT

Figure 1:
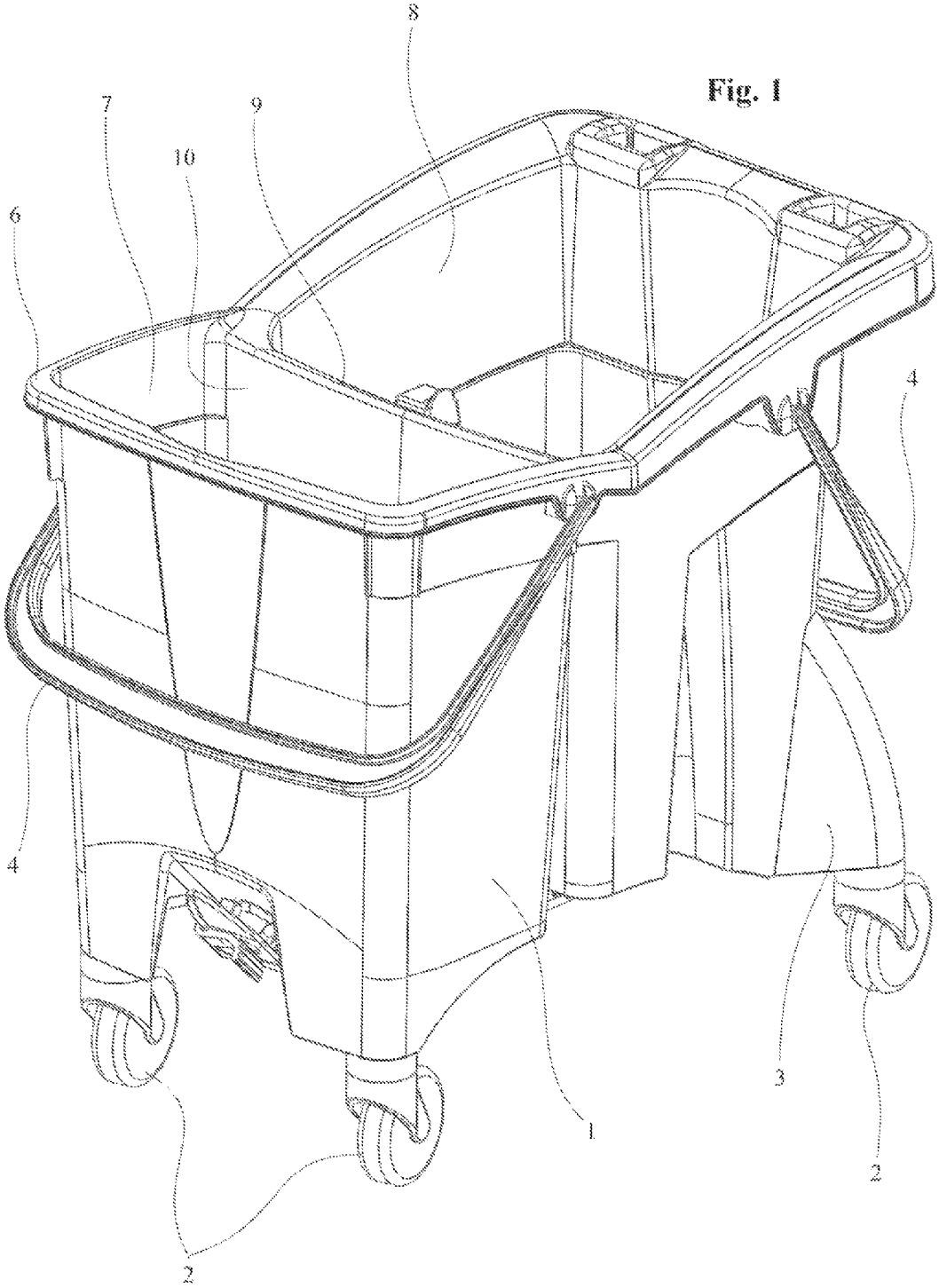
FIG. 1 shows the bucket that is the object of the invention.
Figure 2:
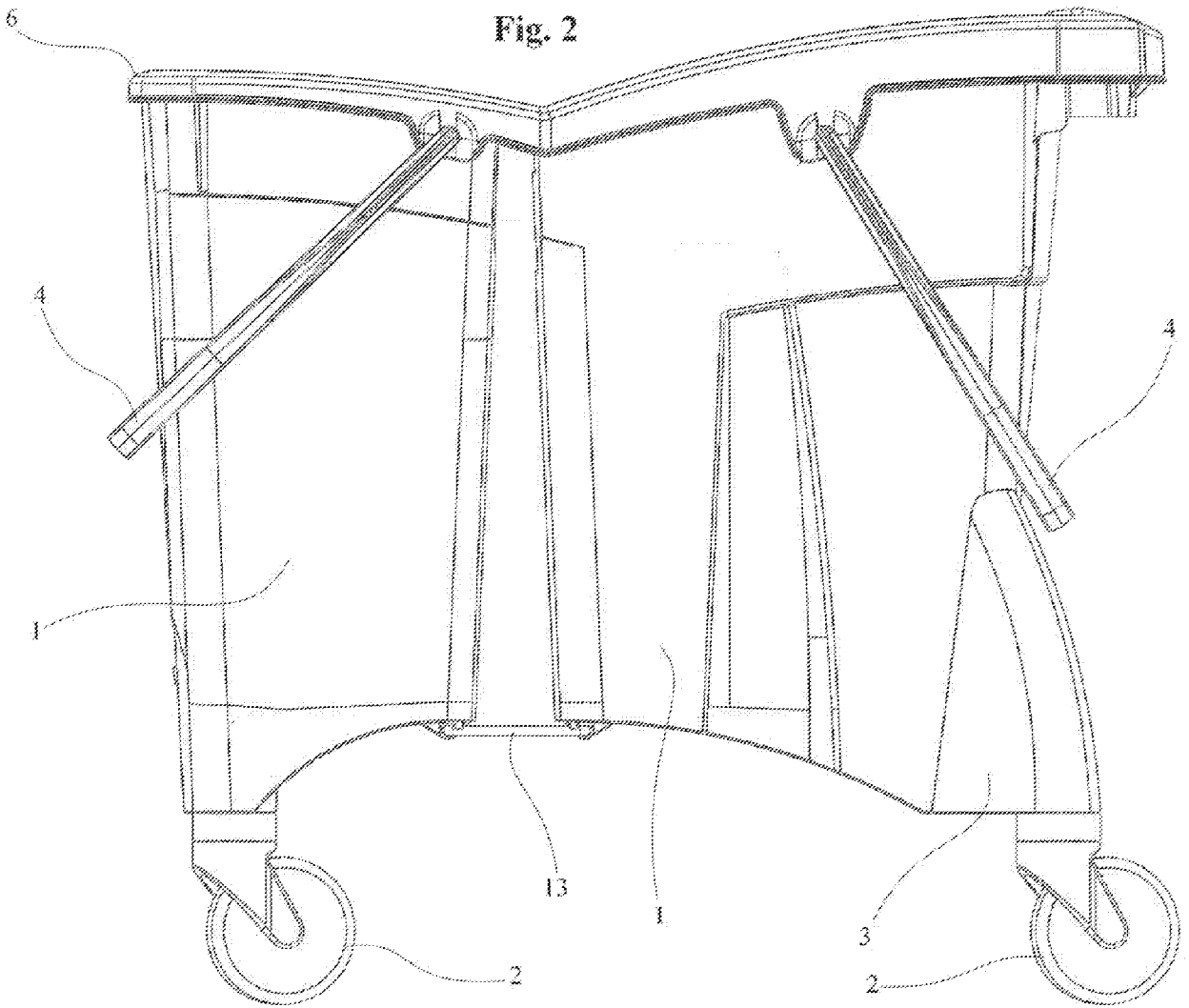
FIG. 2 shows the bucket in FIG. 1 viewed from the side, with a plane view.
Figure 3:
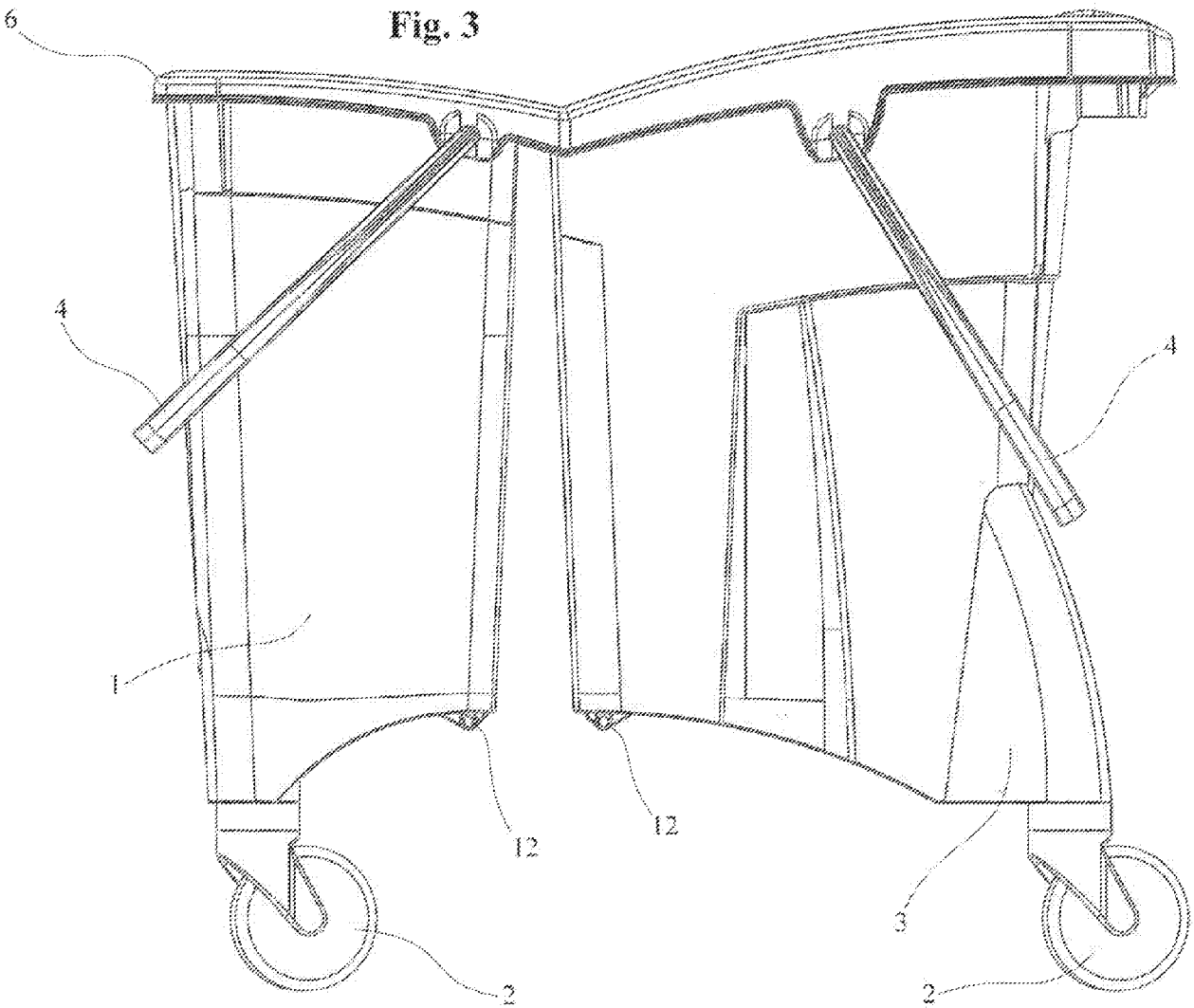
FIG. 3 shows the bucket in FIG. 2 from which the lower spacer elements have been removed.
Figure 5:
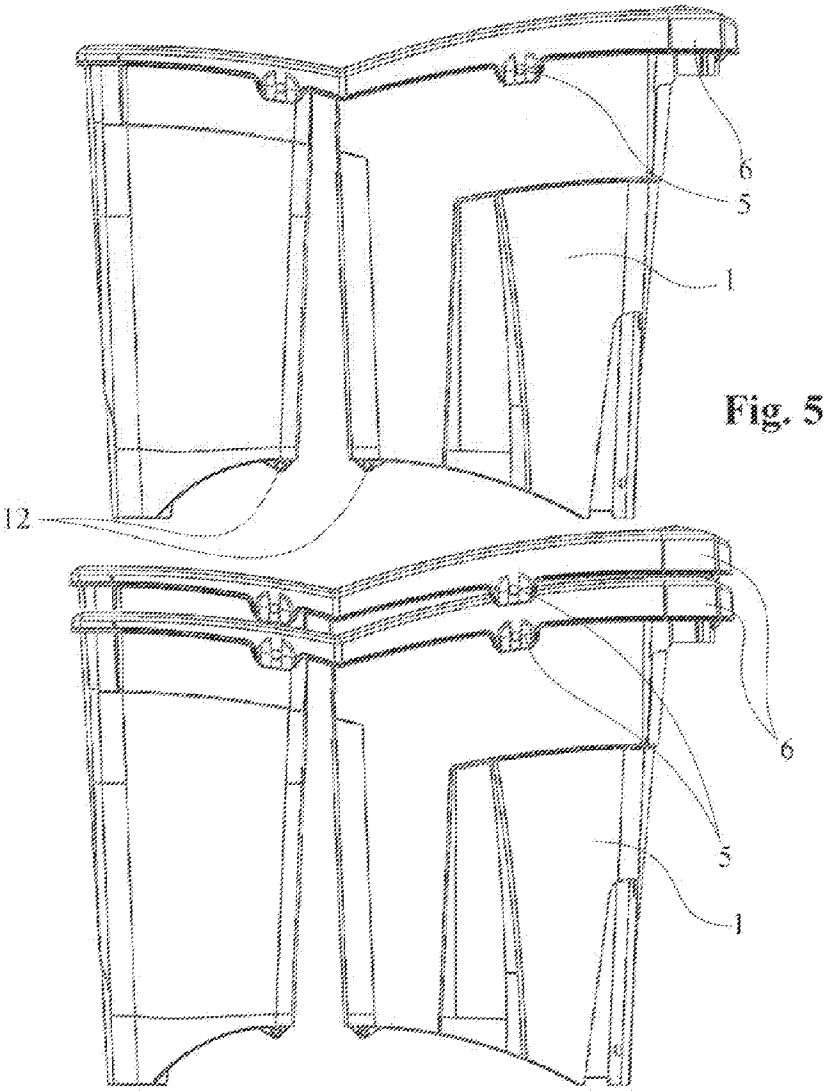
FIG. 5 shows three buckets after two have been stacked one inside the other and the third bucket, above the second, before being stacked inside said second bucket.
Figure 4:
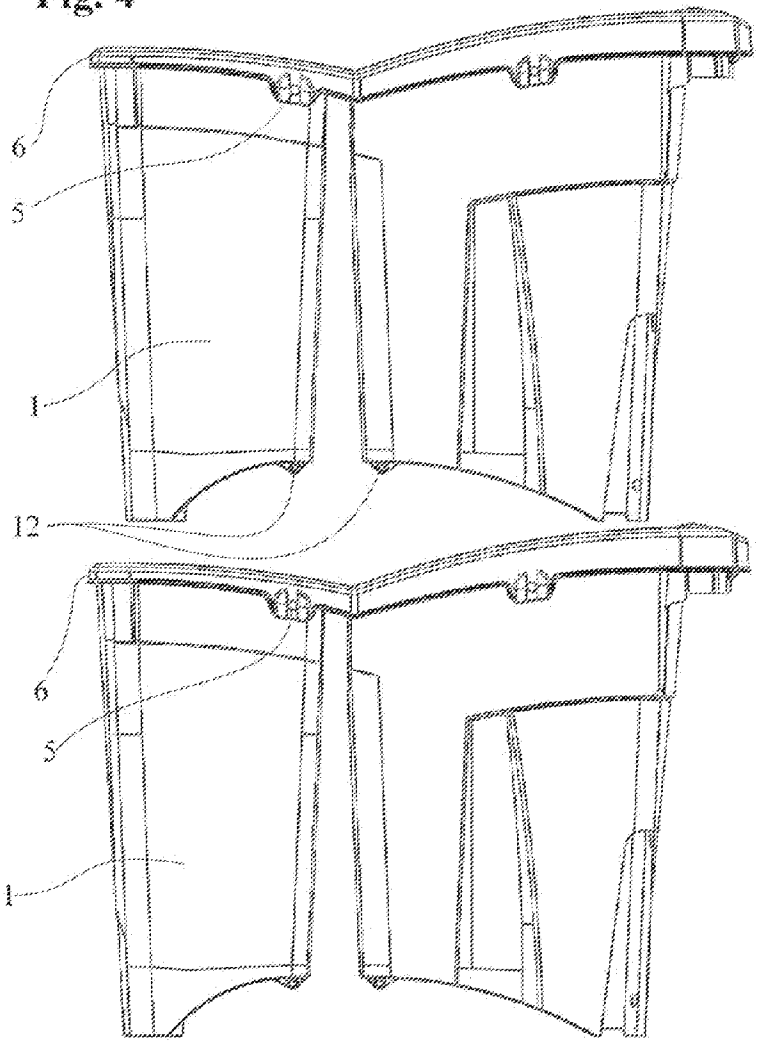
FIG. 4 shows a bucket of FIG. 3 from which the top handles, the bottom wheels and the front side extensions (below which the two front wheels were fixed) have been removed, where said bucket is placed above a similar bucket, before being stacked one inside the other.
Figure 8:
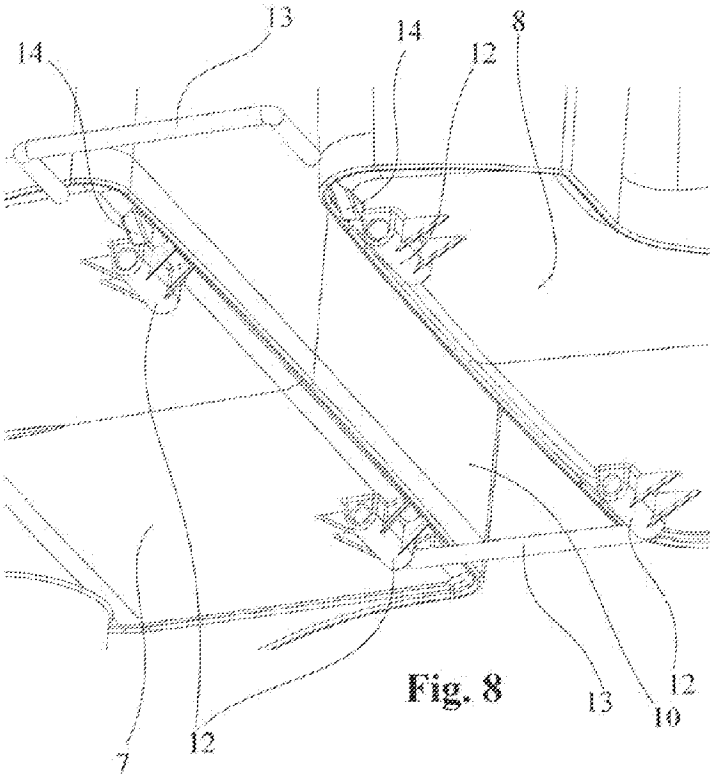
FIG. 8 shows the details of FIG. 6 with a spacer element before being inserted into its housing.
Figure 6:
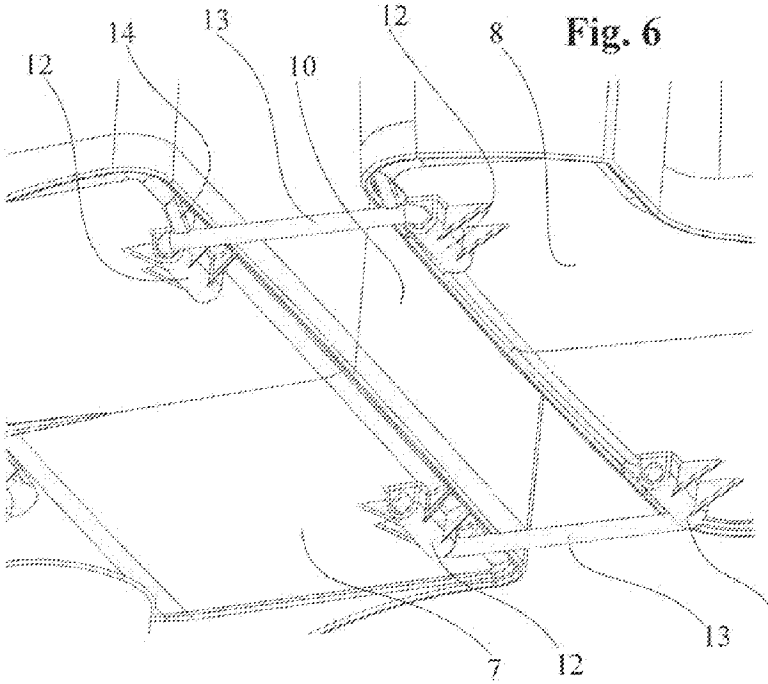
FIG. 6 is a perspective view from below of the lower spacer elements in their housings underneath each compartment.
Figure 7:
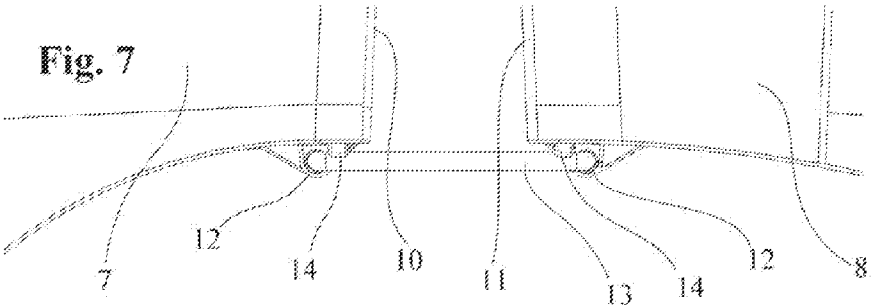
FIG. 7 is a side view of FIG. 6.

With reference to the drawings, the cleaning bucket 1 that is shown is a wheeled cleaning bucket, namely one with wheels 2, applied on the bottom to side expansions 3 (or side extensions) which can be removed from the structure of the bucket 1.

Said bucket has handles 4, whose housings 5 are near the edge 6 of the bucket 1.

This bucket has two compartments 7, 8 divided by a partition 9.

This partition 9 is composed of two walls 10, 11 joined only at the top and each part of the side surface of the respective compartment 7, 8.

At the bottom of the bucket, near the bottom edge of each compartment that faces the adjacent compartment there are the housings 12 into which the spacer elements 13 are inserted.

In this specific case, the housings 12 are holes with a circular section inside which the C-shaped spacer elements 13 are pushed.

In order to prevent an accidental uncoupling of the elements 13 from their housings, there is a no-return mechanism 14.

Any modification to the configuration of the spacer elements is foreseeable like a casing on the outside of the space of the partition between the two walls 10, 11 that form it.

The current invention naturally includes any other form, which is plausible and has the same effect as the spacer elements that when inserted or applied or joined after the bucket is removed from the mold, provide it with the necessary structural strength, while keeping the two compartments, which are just joined at the top by the partition, solidly joined together. And which at the same time provide for, when not inserted or applied or joined, or in a non-active position, the easy stacking of one bucket inside another to provide that sought after saving of space for storage purpose.

As can be seen when comparing pictures 4 and 5 there is a substantial saving of space between two buckets with a partition that are not stacked, where the total space is equal to the sum of the space occupied by each bucket, and two or more buckets with a partition that are stackable in line with what was set out above. Falling within the scope of patent are solutions that experts in the field might carry out with improvements using the instructions in this patent.

While a particular form of the invention has been illustrated and described, it will be apparent that various modifications can be made without departing from the spirit and scope of the invention. Accordingly, it is not intended that the invention be limited, except as by the appended claims.

What is claimed is:

1. A stackable cleaning bucket comprising:

at least two compartments side-by-side;

a partition panel that divides said at least two compartments and connects said at least two compartments at least at a top;

a rigid spacing element removably and repositionably positioned at least on a lower part of the bucket to connect said at least two compartments, ensuring sufficient structural rigidity for said cleaning bucket the spacing element keeping the at least two compartments inflexibly and solidly joined together with a set space therebetween;

the stackable cleaning bucket including side extensions, the space for stacking being obtained with the removal of said side extensions;

whereby the bucket can be stacked, when equipped with the spacing element, or positioned in a non-interfering way inside a similar bucket, so that the bucket goes into the similar bucket almost to the reinforced edge at the top of the bucket.

2. The stackable cleaning bucket according to claim 1, characterized by the fact that said spacing element is a C-shaped clevis, where ends of the C-shaped clevis engage in a plurality of special housings on a lower part of said compartments.

3. The stackable cleaning bucket according to claim 1, characterized by the fact that said spacing element is an element that continually connects a peripheral surface of the bucket at a narrow space of the partition panel.

4. The stackable cleaning bucket according to claim 1, characterized in the fact that said spacing element is obtained directly during the molding of the bucket and can be arranged in at least two positions, a first position being unused, which does not prevent the stacking of one bucket inside another, and a second position connecting the two compartments in such a way that it gives the bucket the required structural rigidity.

5. The stackable cleaning bucket according to claim 1, characterized by the fact a housing for handles is positioned near the top reinforced edge of the bucket such that during stacking the handles take up a position next to the upper edges.

6. A stackable cleaning bucket comprising:

a first compartment;

a second compartment;

a partition dividing the first compartment and the second compartment, the partition forming adjacent sides of the first compartment and the second compartment, the partition joining the first compartment and the second compartment along a top portion of the adjacent sides, the partition forming a space between the first compartment and the second compartment;

at least one rigid_spacer element disposed outside of the space between the first compartment and the second compartment, the at least one spacer element keeping the first and second compartments inflexibly and solidly joined together with a set space therebetween;

at least one housing disposed on a lower surface of each of the first compartment and the second compartment, wherein a first end of the at least one spacer element is removably and reinsertably positioned into the housing on the first compartment; and a second end of the at least one spacer element is removably and reinsertably positioned into the second compartment.

7. The stackable cleaning bucket of claim 6, wherein the at least one spacer element is two spacer elements.

8. The stackable cleaning bucket of claim 6, wherein the at least one spacer is formed in a C-shape.

* * * * *